United States Patent [19]

Björnberg

[11] Patent Number: 4,513,516

[45] Date of Patent: Apr. 30, 1985

[54] METHOD OF AND APPARATUS FOR THE HEAT-TREATMENT OF A CONTINUOUS WEB

[76] Inventor: Thomas Björnberg, Viksängen, S-460 60 Vargön, Sweden

[21] Appl. No.: 525,677

[22] Filed: Aug. 23, 1983

[30] Foreign Application Priority Data

Sep. 8, 1982 [SE] Sweden ..... 8205095

[51] Int. Cl.[3] ..... F26B 3/32

[52] U.S. Cl. ..... 34/41; 34/4; 34/49

[58] Field of Search ..... 34/4, 41, 49; 162/207, 162/375

[56] References Cited

U.S. PATENT DOCUMENTS

| | | | |
|---|---|---|---|
| 2,166,379 | 7/1939 | Skagerberg | 34/49 |
| 2,796,678 | 6/1957 | McKeown | 34/49 |
| 3,085,347 | 4/1963 | Justus | 34/49 |
| 3,619,103 | 11/1971 | Williams | 34/41 |
| 3,722,105 | 3/1973 | Marteny | 34/49 |
| 4,408,400 | 10/1983 | Colapinto | 34/41 |
| 4,434,562 | 3/1984 | Bubley et al. | 34/41 |

*Primary Examiner*—Edward G. Favors
*Assistant Examiner*—Steven E. Warner

[57] ABSTRACT

In a method of and apparatus for the heat-treatment of a continuous web, more particularly the drying of a paper web, infra-red heat elements are arranged adjacent the web, and the web is transferred from a drying cylinder to a roll forming station with a drying unit situated above the web path and a movable roller below the same. When proper operating conditions are reached, the movable roller is elevated into the drying unit and past the infra-red heat elements. A bottom portion of the drying unit depends from the movable roller or parts connected therewith.

7 Claims, 1 Drawing Figure

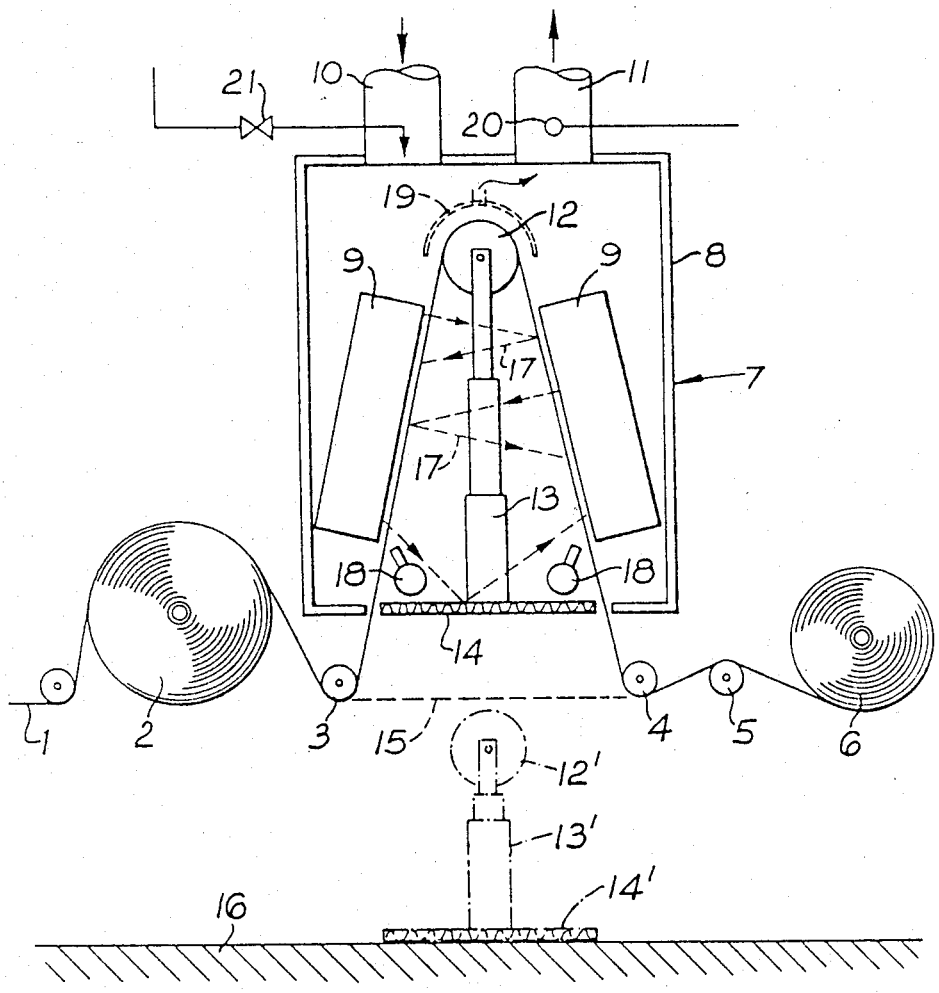
21
10
11
20
19
12
9
9
8
7
17
17
13
18
18
14
1
2
3
15
4
5
6
12'
13'
14'
16

METHOD OF AND APPARATUS FOR THE HEAT-TREATMENT OF A CONTINUOUS WEB

BACKGROUND OF THE INVENTION

This invention relates to a method of and apparatus for the heat-treatment of a continuous web, for example for drying a paper web, in which the web is taken through a drying unit with the aid of at least one movable roller and is taken through a drying unit with the aid of at least one movable roller and is constrained to follow a U-shaped path within said drying unit, the web being exposed to drying elements within the drying unit.

It is already known to use infra-red heat for instance, for drying a paper web. According to this previously-known technique infra-red heating elements may be arranged at various positions in, for instance, a paper-making machine, e.g. at the outlet end of such a machine in order to promote final drying and at positions associated with or between rollers at the beginning of the paper machine to promote initial drying. These arrangements have advantages in comparison with conduction or convection drying.

OBJECTS OF THE INVENTION

Heretofore the advantages of the infra-red heating method have not been fully utilized for drying the web in a paper-making machine. The presently-known infra-red dryers have low thermal efficiency, since it has not been possible to make well-enclosed drying units which at the same time are easily accessable for a fast and reliable introduction into the unit of the paper web, for instance after a web break. The dryer must also be constructed to prevent accumulation of paper in the dryer, and possibly a fire, after a web break, which may occur at full machine speed of 100 to 1,500 m/min. Therefore it is an object of this invention to improve this known method and develop the same further.

The reason for such further development lies in the fact that even if only a small percentage or marginal energy savings are achieved, for instance they can result in a very significant result when calculated, for instance, on a yearly consumption. In addition to reducing energy consumption, it is a further object of the invention to render possible the reduction of the size and of the material involved in a treatment plant, such as a paper-making machine, to reduce the treatment time and/or make possible higher web speeds and last but not least to create the necessary conditions for achieving a product of good and uniform quality with simple and reliable means. Furthermore dependability of operation should desirably be improved and installation as well as operation, supervision and maintenance should be enhanced.

SUMMARY OF THE INVENTION

These objects are achieved by the provision, in accordance with the invention of a method of heat treatment of a continuous web, such as a paper web, in which the web is taken through a drying unit with the aid of at least one movable roller and is constrained to follow a U-shaped path within said drying unit, the web being exposed to drying elements within the drying unit, characterized in that prior to introduction of the web into the drying unit, the web is caused to follow a straight path outside said drying unit and the movable roller is disposed in a rest position distant from and at the opposite side of said straight path, and in that the web is then taken by the movable roller, into the drying unit so as to follow a U-shaped path defined by the movable roller, at the extreme position, and deflector rollers.

As a further feature, the invention provides apparatus for the heat treatment of a continuous web such as a paper web comprising a drying unit, at least one movable roller arranged to bring in the web into the drying unit and constrain it to follow a U-shaped path within said drying unit adjacent to at least one panel of drying elements within said drying unit, characterized in that the movable roller is movable from a rest position at the opposite side of a straight path of the web, relative to the drying unit, to engage the web, when running, and bring it into the drying unit and constrain it to follow a U-shaped path within said drying unit as defined by the movable roller in its extreme position and deflector rollers.

In carrying the invention into effect, in one way, one infra-red drying unit is located on each side of a U-shaped run of the web. The advantage arising from this is that the infra-red radiation, which passes through the paper layer, is afforded the opportunity of being absorbed by the paper several times. In the invention this feature is achieved with the movable roller which makes it possible to delay the bringing up of the paper web into the drying unit, until the web is running stably over its full width. It is to be understood, of course, that after the occurrence of a web breakage only a narrow tongue of paper is first threaded through the apparatus and this must be progressed through until the full paper width is passing through.

The arrangement of the invention also makes it possible to operate the paper machine without engaging the drying unit and in this way to achieve improved flexibility, as well as the possibility of servicing during full production. The heat supply is preferably interlocked, such that the heat cannot be switched on until the movable roller is in its top or operative position in which it constrains the paper web to follow its U-shaped path through the dryer.

The drying unit is suitably ventilated and the raising and/or lowering of the movable roller may be effected manually or automatically with suitable equipment and suitable auxiliary devices. Such an operating method and equipment also make it possible to guide the web closely adjacent to the infra-red units, in which case there are preferably safety switches which immediately switch off the electrical power to the infra-red units (which may be in the form of cassettes) in the event of web breakage and/or other operational fault.

BRIEF DESCRIPTION OF THE DRAWING

Additional features of and advantages of the invention are evident from the following description with reference to the accompanying drawing in which the single FIGURE is a schematic side view illustrating a preferred non-limiting embodiment of the apparatus of the invention.

DESCRIPTION OF THE ILLUSTRATED EMBODIMENT

The FIGURE schematically shows how the apparatus of the invention may be installed in conjunction with a paper-making machine. Only the discharge end of the paper-making machine is shown and in the FIGURE it can be seen how the paper web 1 leaves a drying cylinder 2 and with the aid of guide rollers 3, 4 and 5 is transferred to a roll-forming station 6 which is shown only as a paper roll. The inventive drying unit 7 is arranged above the path of the paper web 1. The drying unit 7 comprises a housing 8, suitably made of aluminum sheet or other suitable material with high heat reflective characteristics. In the housing 8 there are arranged two infra-red heating units in the form of infra-red heating panels 9 provided with reflectors and disposed with their heat-radiating surfaces facing each other. The infra-red heat panels 9 are externally insulated to condensation of water in the infra-red heating elements. The housing 8 is provided with a ventilation air inlet 10 and a ventilation air outlet 11 connected to a ventilation system. Ventilation air from the inlet 10 is used to cool the power supply means and the infra-red elements, as well as for removal of evaporated water. This air is sucked through the infra-red heating panels 9 or through separate suction conduits. The infra-red heat panels 9 may advantageously be divided into sections, thus making it possible to supply different amounts of heat over different parts of the width of the paper web 1. The heat is then preferentially supplied to the moist parts of the paper web 1.

The drying unit 7 is provided with a movable pick-up roller 12 attached to telescopic beams 13 which connects it with a movable floor 14 to the drying housing 8. When the paper machine is started up, for instance after a web breakage, or when the drying unit 7 is not in use, the paper web 1 is guided along a straight path 15 indicated by a broken line. The movable roller, telescopic beams 13 and the movable floor 14 are then disposed at a lower position as indicated at 12', 13' and 14' in broken lines close to the ground or others supporting structure 16 beneath the paper making machine. The paper web 1 is brought into the drying unit 7 by raising the movable roller 12 by use of lifting devices (not shown) from its lowered position 12' to an extreme top or raised position 12. The paper web 1 now follows a roughly U-shaped path within the drying unit 7, in which both limbs of the U run with their outer surfaces immediately adjacent to the infra-red heating panels 9. When the movable roller 12 reaches its extreme top position 12, it engages an interlocking switch (not shown) belonging to an infra-red heat panel control system, and power can now be supplied to the infra-red heating panels. As indicated diagrammatically by the dotted arrows 17, the infra-red radiation firstly passes through the first limb of the U, then the other limb, is reflected by the reflector of the opposite infra-red heating panel, passes through the second limb of the U, then through the first limb of the U, to be reflected by the reflector of the infra-red panel which originally emitted the radiation, whence it passes through the first limb of the U, and so on until the heat is fully absorbed by the paper web or it manages to escape at the side of the web 1. This affords a very good utilization of the drying heat, and can result in substantial energy savings. The efficiency of the drying unit 7 is further enhanced by the floor 14 which reflects the heat and contributes to making the unit a closed one. This floor 14 can also be used as a walkway for servicing and maintenance personnel, and will inhibit the spread of fire. At the side of the web 1 facing away from the infra-red elements there may be a movable air nozzle ramp 18 which assists removal of moisture from the back of the paper web 1. The movable roller 12 is covered at its top by a perforate sheet or suction hood 19 for the purpose of preventing paper from collecting in the top of the drying unit 7 in the event of web breakage.

The drying unit 7 is provided with an interlocking control system which is connected to a fire detector 20, which will sense smoke and/or an open flame within the drying unit 7. The interlocking system is also connected to a web breakage detector (not shown) of the paper machine. In the event of a fire or a web breakage the power supply to the infra-red heat panels is interrupted and the movable roller 12 is lowered to its bottom position 12'. In the event of a fire in the drying unit 7, a valve 21 opens and a fire extinguishing gas, suitably steam, is supplied to the interior of the drying unit 7. This interlocking system also prevents power from being supplied to the infra-red heating panels whenever the movable roller 12 is not at its extreme top position.

The embodiment described above and shown in the accompanying drawing is in no way limitative of the invention, and the details illustrated and described can be changed and supplemented as desired within the scope of the invention as achieved by the following claims. Thus, for example the described cassettes may constitute parts of the wall of the drying unit 7.

I claim:

1. A method of heat treatment of a continuous web, such as a paper web, comprising the steps of providing a drying unit having at least one movable roller connected to a movable floor , taking the web through said drying unit with the aid of said at least one movable roller connected to said movable floor, constraining the web to follow a U-shaped path within said drying unit, arranging said movable floor to close the space between the two limbs of said U-shaped path within said drying unit, exposing the web to drying elements within the drying unit, causing the web to follow a straight path outside said drying unit and disposing the movable roller in a rest position distant from and at the opposite end of said straight path prior to introduction of the web into the drying unit, and then taking the web, by the movable roller, into the drying unit so as to follow the U-shaped path defined by the movable roller, at its extreme position, and deflector rollers.

2. A method as set forth in claim 1, wherein the drying elements are controlled by an interlocking system such that the heat is first switched on when the movable roller reaches its extreme position and is switched off when the movable roller leaves its said extreme position.

3. A method as set forth in claim 1, wherein the web is exposed to heat radiation from at least one panel of heating elements situated outside at least one limb of the U, the heat radiation passing through both limbs of the U-shaped web and heat radiation not absorbed by the web being reflected by reflection surfaces in opposite heat elements or a separate reflector beyond the opposite limb of the U, thereby to provide multiple passes of the heat radiation through the web.

4. Apparatus for the heat treatment of a continuous web, such as a paper web, comprising a drying unit, at least one movable roller arranged to bring the web into the drying unit and constrain it to follow a U-shaped path within said drying unit adjacent to at least one panel of drying elements within said drying unit, the movable roller being movable from a rest position at the opposite side of a straight path of the web relative to the drying unit, to engage the web when running and bring it into the drying unit and constrain the web to follow a U-shaped path within said drying unit as defined by the movable roller in its extreme position and deflector rollers, and a movable floor connected with the movable roller, which movable floor moves together with the roller and is arranged to close the space between the two limbs of the U-shaped path of the web, to thereby make the drying unit a closed confinement.

5. Apparatus as set forth in claim 4, wherein heat radiation panels are provided at the outside and adjacent to both limbs of the U-shaped path of the web, said heat radiation panels being provided with reflectors facing the web so that heat radiation passing both runs of the web and is reflected by the opposite panel, thus making multiple passes through the web.

6. Apparatus as set forth in claim 4, wherein one heating element panel is provided adjacent the outside of one limb of the U-shaped path which is also provided with a reflector facing said path, and a reflector is provided outside the opposite limb of the U-shaped path, said reflector serving to reflect the heat radiation from the heating element panel.

7. Apparatus as set forth in claim 4 wherein the movable roller, in its top position, is surrounded by a cover which encloses the path of the web and connects with the heat radiation panels and the reflector.

* * * * *